United States Patent [19]

Archbold

[11] 4,236,559

[45] Dec. 2, 1980

[54] WINDOW SCHOOL BAG

[76] Inventor: Ellard Archbold, 82 Hendricks Ave., 2nd Floor, Staten Island, N.Y. 10301

[21] Appl. No.: 63,992

[22] Filed: Aug. 6, 1979

[51] Int. Cl.[3] ..... A45C 3/02

[52] U.S. Cl. ..... 150/1.6; 150/42

[58] Field of Search ..... 150/1.6, 7, 33, 42, 150/46

[56] References Cited

U.S. PATENT DOCUMENTS

| | | | |
|---|---|---|---|
| 2,159,995 | 5/1939 | Lifton | 150/1.6 |
| 2,755,837 | 7/1956 | Kosek | 150/1.6 |
| 3,078,897 | 2/1963 | Rifkin | 150/13 |
| 3,521,689 | 7/1970 | Woods | 150/7 X |
| 3,545,659 | 12/1970 | Libby | 150/33 X |
| 3,818,963 | 6/1974 | Whitman | 150/15 |
| 3,874,435 | 4/1975 | Allen | 150/1.6 |
| 3,945,415 | 3/1976 | Febuary | 150/7 |
| 4,068,786 | 1/1978 | Taniguchi | 150/33 X |

*Primary Examiner*—Donald F. Norton
*Attorney, Agent, or Firm*—Richard L. Miller

[57] ABSTRACT

A school bag including a snapped on cover and adjustable shoulder strap, and a front side of the bag also having a clear plastic window behind which is a pocket into which an identification card such as a bus pass is insertable through a slit from inside the bag so to be viewed from outside.

3 Claims, 3 Drawing Figures

WINDOW SCHOOL BAG

BACKGROUND OF THE INVENTION

This invention relates generally to satchels and school bags. It is well known that many children today are transported to and from schools by means of municipal buses of cities and towns, and instead of paying a fare, the children show a bus pass to the bus driver. Such passes, carried loosely in a garment pocket or inside a school bag together with books, often gets misplaced or lost, so as to require replacement. This situation is in need of an improvement.

SUMMARY OF THE INVENTION

Accordingly it is a principal object of the present invention to provide a school bag which carries the bus pass in a displayed manner, so that the child does not have to fumble inside the bag or in a garment pocket for removal in order to show the bus driver, thereby preventing the possibility of a loose bus pass card from being easily dropped, lost or misplaced.

Another object is to provide a windowed school bag for displaying the bus pass which eliminates the need of children to handle a bus pass when boarding a bus while their already occupied hands, carrying books, may additionally be possibly needed to grasp a handrail while climbing up into the bus.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF PREFERRED EMBODIMENT

Figure 1:
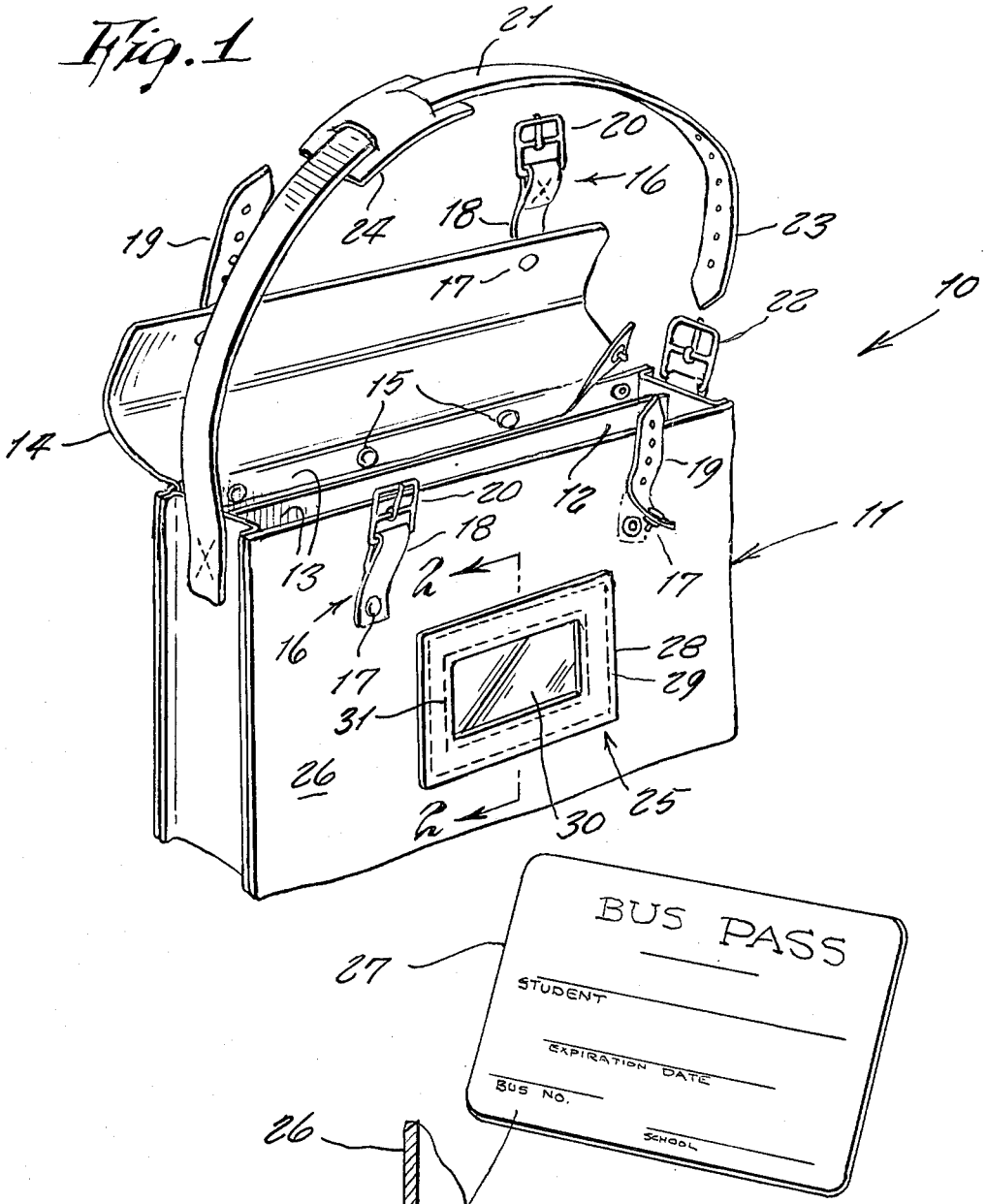
FIG. 1 is a perspective view of a school bag with the invention incorporated therein.
Figure 2:
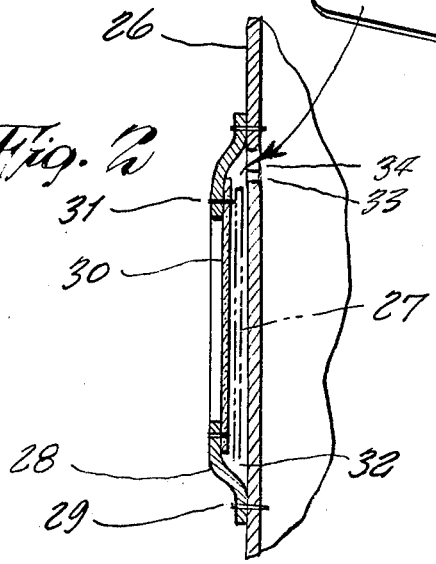
FIG. 2 is a cross sectional view on line 2—2 of FIG. 1.
Figure 3:
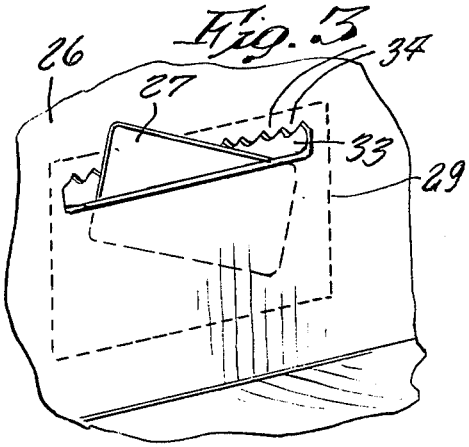
FIG. 3 is a view from inside the bag.

Referring now to the drawing in greater detail, the reference numeral 10 represents a window school bag according to the present invention wherein there is a bag member 11 which may or may not include partitions 12 so to form a plurality of compartments 13 in which school books, notebooks and the like may be placed. A bag cover 14 is snapped over a top opening of the bag by means of snap fasteners 15 along one edge, and a pair of strap sets 16 secured by snap fasteners 17 along an opposite edge. Each set 16 includes straps 18 and 19 and a buckle 20. A flexible shoulder strap 21, stitched at one end to one end of the bag, is adjustable in length by means of a buckle 22 secured at an opposite end of the bag, receiving a free end 23 of the strap. A pad 24 is slidable along the strap for a selected adjustment.

The bag, cover, straps and pad may be made of any desirable material and are generally made of a leather or a flexible plastic so to less expensively simulate a leather. The partitions are usually of a more stiff material such as semi-rigid plastic panels.

In the present invention, a window 25 is provided on a front side 26 of the bag so as to display a bus pass card 27 or other identification card, as wished. The window includes a leather or plastic frame 28 stitched to an outer side of the bag by means of thread 29. A clear plastic window pane 30 is stitched by thread 31 across the frame opening. A pocket 32, thus formed is accessible by a slot 33 through the bag side 26, so that in use the card 27 can be inserted from inside the bag into the pocket. Thus the card is inaccessible from an outside for being stolen. The slot 33 is at a top end of the pocket, and a top horizontal edge of the slot is serrated with teeth 34 so as to block the slot from easy entry by the card and accidently falling out if the bag is tipped over or laid on its side. The pocket depth below the slot is accordingly made to be greater than a height of the card, so that the upper edge of the card gets caught among the teeth if accidently upwardly slided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A window school bag, comprising in combination, a bag member, a partition forming a plurality of compartments inside said bag member, a cover snapped over a top opening of said bag member, a shoulder strap, fitted with adjustable pad, being attached across opposite ends of said bag member, and a window on a front side of said bag member for displaying a bus pass and other identification cards; said window comprising a frame fitted with a transparent plastic pane, said frame being stitched on an outer surface of said bag member front side, and a horizontal slot through said front side for access of said card into a pocket formed between said front side and said pane; said slot being near an upper end of said pocket, and an upper horizontal edge of said slot being serrated with depending teeth so as to block accidental entry of said card from said pocket and outwardly through said slot.

* * * * *